US006005557A

United States Patent [19]

Wong

[11] Patent Number: 6,005,557

[45] Date of Patent: Dec. 21, 1999

[54] IMAGE DISPLAY STABILIZATION APPARATUS AND METHOD

[75] Inventor: Anthony Earl Wong, San Diego, Calif.

[73] Assignee: Proxima Corporation, San Diego, Calif.

[21] Appl. No.: 08/659,943

[22] Filed: Jun. 7, 1996

[51] Int. Cl.[6] ..... G09G 5/00

[52] U.S. Cl. ..... 345/204; 345/213

[58] Field of Search ..... 345/204, 94, 211, 345/213; 348/653, 654

[56] References Cited

U.S. PATENT DOCUMENTS

| | | | |
|---|---|---|---|
| 4,991,023 | 2/1991 | Nicols | 358/242 |
| 5,448,193 | 9/1995 | Baumert et al. | 327/156 |
| 5,828,351 | 3/1997 | Wu | 345/204 |
| 5,850,215 | 9/1995 | Kamiya et al. | 345/204 |

*Primary Examiner*—Richard A. Hjerpe
*Assistant Examiner*—Ronald Laneau
*Attorney, Agent, or Firm*—Higgs, Fletcher & Mack LLP; Bernard L. Kleinke

[57] ABSTRACT

A display panel image stabilization method and apparatus includes enabling a user to adjust both the pixel clock pulses and the synchronization for the display panel simultaneously by a single control. The synchronization is adjusted in a stepwise manner through a given number of steps for a particular number of clock pulses. The image is observed by the user to determine whether or not the noise stripes are being eliminated. The stepwise adjustment of the synchronization is repeated for another particular number of clock pulses if the noise stripes are not being eliminated. Once all of the stripes have been eliminated from the image, both the synchronization and the pixel clock pulses are properly adjusted to stabilize the image.

16 Claims, 8 Drawing Sheets

IMAGE DISPLAY STABILIZATION APPARATUS AND METHOD

TECHNICAL FIELD

The present invention relates in general to a new and improved method and apparatus for stabilizing an image formed on a display panel. More particularly, the invention relates to a new and improved method and apparatus for stabilizing the image formed on a display panel, such as a display panel used in projecting computer generated images.

BACKGROUND ART

Display panels, such as liquid crystal display (LCD) panels have been employed for displaying images, such as those created by computers. Such an LCD panel is arranged in pixel elements configured in a matrix of columns and rows. When the information indicative of a display image is scanned across the LCD panel to create an image frame, each row of pixel elements are activated selectively by an image information signal.

In order to synchronize the image information signal with the individual pixel elements, a horizontal synchronization (HSYNC) signal is generated for each row of the matrix of pixel elements. Furthermore, a pixel or dot clock (DCLK) signal is derived from the HSYNC signal and has an individual clock signal for each pixel element in each row.

If the DCLK signal is not properly and precisely synchronized with the image information signal, a distorted or noisy image results. In this regard, if there are too many or too few individual clock pulses generated for a given row of pixel elements, unwanted and undesirable vertical stripes appear on the image. Generally, there would be one stripe for each additional or missing clock pulse. Additionally, if the synchronization of the DCLK signal phase with the image information signal phase is not precisely accomplished, the image is also distorted.

Thus, the number of individual clock pulses must be adjusted, and the phase of the DCLK signal must be synchronized with the phase of the image information signal, to precisely stabilize the resulting image. In order to accomplish this, a phase locked loop circuit has been employed to precisely adjust the number of clock pulses for each row of pixel elements. The phase locked loop circuit was adjusted by the user to adjust the number of pulses corresponding to the pixel elements of a given row. Additionally, a delay circuit was employed to adjust the synchronization of the phases. The user was then required to adjust the delay for the delay circuit to adjust the synchronization.

By adjusting the phase locked loop circuit, the noise stripes can be eliminated. However, since the phase must also be adjusted by the user at the same time, it frequently is difficult for the user to accomplish both adjustments simultaneously to give the optimum stabilization of the image. For example, it can happen that a user can reduce the number of noise stripes onto a single one and then attempt to adjust the phase. Since there are not the correct number of clock pulses being generated, the adjustment to the phase cannot be entirely effective to optimize the stabilization of the image.

Generally, the phase locked loop was passively preset for operation in a particular environment to help display a stabilized image. Factors, such as cable impedance or differing signal paths, can adversely affect the synchronization of the system. Thus, the complicated and confusing adjustment had to be repeated, thereby frustrating the user.

The stabilization of a displayed image could, thus, prove to be extremely difficult for users unaccustomed to adjusting the operation of a phase locked loop. Without a technical understanding of the adjustments required to stabilize an image, a user was liable to make adjustments which would prevent the image from becoming stabilized. As a result, the user could become frustrated and settle for a less than ideal displayed image, thereby reducing the effectiveness of the image.

Therefore, it would be highly desirable to greatly simplify the image stabilization adjustments by a user. In this regard, the adjustment technique should be convenient to use and result in an optimum stabilization.

DISCLOSURE OF INVENTION

Therefore, the principal object of the present invention is to provide a new and improved display panel image stabilization method and apparatus, wherein the image stabilization can be achieved by a user in a relatively simple and direct manner to achieve an optimum or close to optimum result.

Briefly, the above and further objects are realized by providing a method and apparatus to enable the user to achieve the desired stabilization relative to the pixel clock adjustment and the synchronization by a single control.

A display panel image stabilization method and apparatus includes enabling a user to adjust both the pixel clock pulses and the synchronization for the display panel simultaneously by a single control. The synchronization is adjusted in a stepwise manner through a given number of steps for a particular number of clock pulses. The image is observed by the user to determine whether or not the noise stripes are being eliminated. The stepwise adjustment of the synchronization is repeated for another particular number of clock pulses if the noise stripes are not being eliminated. Once all of the stripes have been eliminated from the image, both the synchronization and the pixel clock pulses are properly adjusted to stabilize the image.

BRIEF DESCRIPTION OF DRAWINGS

The above mentioned and other objects and features of this invention and the manner of attaining them will become apparent, and the invention itself will be best understood by reference to the following description of the embodiment of the invention in conjunction with the accompanying drawings, wherein.

BEST MODE FOR CARRYING OUT THE INVENTION

Figure 1:
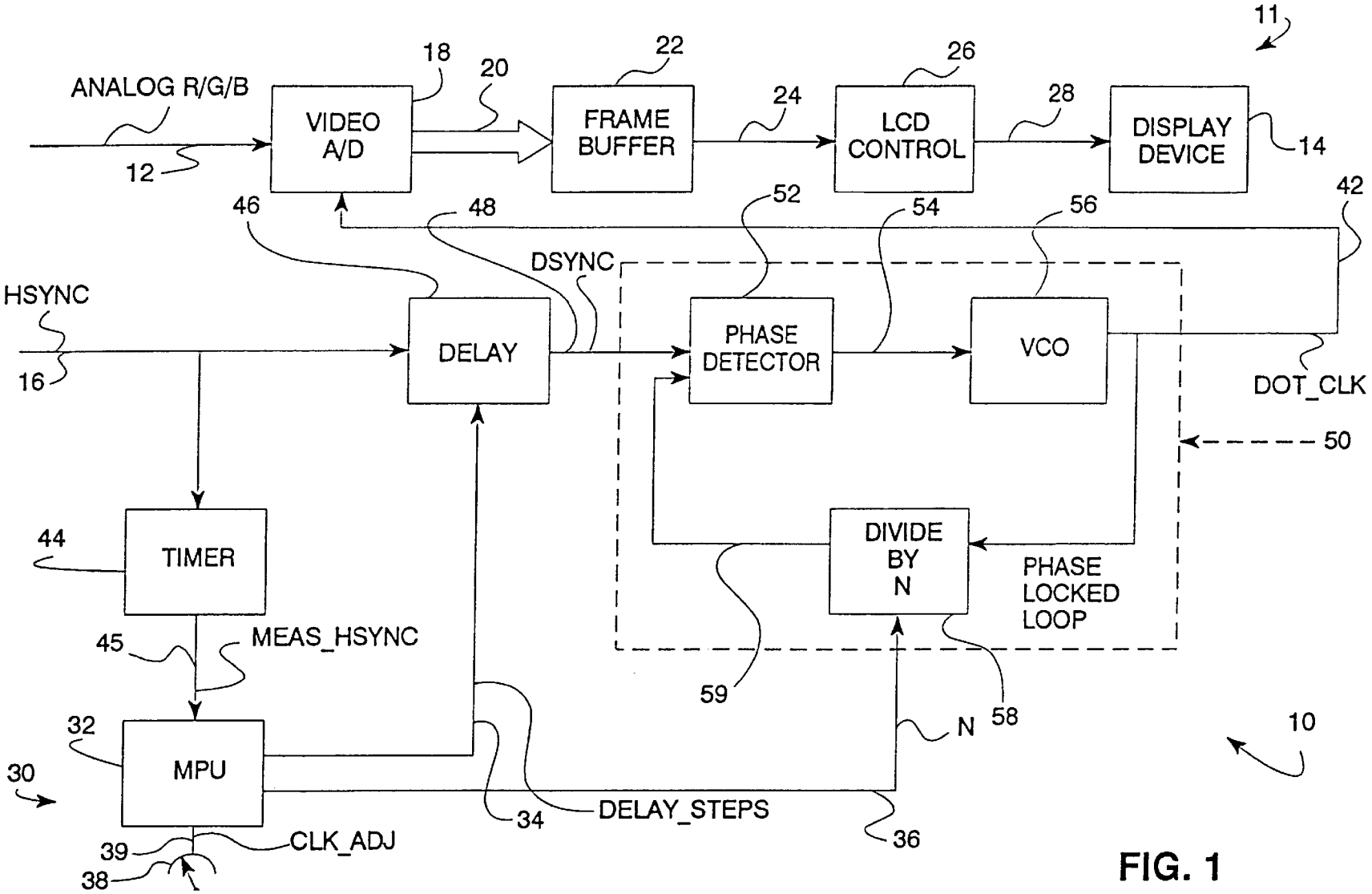
FIG. 1 is a block diagram of an image display stabilization apparatus, which is constructed in accordance with the present invention.

Referring now to the drawings, and more particularly to FIG. 1 thereof, there is shown an image display stabilization apparatus 10 which is constructed in accordance with the present invention. The apparatus 10 cooperates with a display system 11 to facilitate the stabilization of a displayed image in a convenient manner.

A dot clock (DOT_CLK) signal 42 is generated by the apparatus 10 to help the display system 11 display an image (not shown) corresponding to an analog R/G/B image information signal 12. The apparatus 10 utilizes a horizontal synchronization (HSYNC) signal 16 associated with the image information signal 12 to generate the DOT_CLK signal 42. By controlling the phase and frequency of the DOT_CLK signal 42, the apparatus 10 is able to stabilize the display image.

In operation, the display system 11 displays the image information signal 12 as the image in response to the DOT_CLK signal 42. Where the frequency of the DOT_CLK signal 42 does not properly correspond to the frequency of the image information signal 12, at least one vertical noise bar is displayed in the image. Using the apparatus 10 to control the frequency of the DOT_CLK signal 42, the vertical noise bar can be eliminated by a user (not shown) viewing the image.

Although the frequency of the DOT_CLK signal 42 may have been adjusted to correspond to the frequency of the image information signal 12, the associated phases may be off resulting in an overall noisy display. Therefore, the apparatus 10 further adjusts the phase of the DOT_CLK signal 42 in a stepwise manner while maintaining the frequency of the DOT_CLK signal 42 constant. In this way, both the frequency and the phase of the DOT_CLK signal 42 are controlled simultaneously by the apparatus 10 to facilitate the stabilization of the displayed image.

The display system 11 includes a video A/D converter 18 which receives the image information signal 12, and is responsive to the DOT_CLK signal 42 to generate a video information signal 20. A frame buffer 22 utilizes the video information signal 20 to generate a frame signal 24. A liquid crystal display control 26 is responsive to the frame signal 24 to generate a display signal 28 suitable for display as the image on a display device 14.

Considering now the apparatus 10 in greater detail, the apparatus 10 is responsive to the HSYNC signal 16 to produce the DOT_CLK signal 42. In this regard, the apparatus 10 includes a phase locked loop apparatus 50 which helps to generate the DOT_CLK signal 42 in response to the HSYNC signal 16. The phase locked loop apparatus 50 is adjustable to permit the frequency of the DOT_CLK signal 42 to be varied.

The phase locked loop apparatus 50 includes a phase detector 52 for generating a gain signal 54 to help synchronize the phase of the DOT_CLK signal 42 with the phase of the DSYNC signal 48. A voltage controlled oscillator (VCO) 56 is responsive to the gain signal 54 to produce the DOT_CLK signal 42. An adjustable divide by N device 58 is connected between the output of the voltage controlled oscillator 56 and the input of the phase detector 52 to generate a feedback signal 59, wherein the frequency of the DOT_CLK signal 42 may be adjusted by controlling the divide by N device 58. In this regard, the divide by N device 58 is adjustable to facilitate varying the gain signal 54, thereby enabling the frequency of the dot clock signal 42 to be adjusted as desired.

An adjustable delay device 46 coupled to the phase locked loop apparatus 50 modifies the phase of the HSYNC signal 16 to generate a delay synchronization (DSYNC) signal 48, wherein the DSYNC signal 48 is substantially similar to the HSYNC signal 16 except for the phase difference. The DSYNC signal 48 is utilized by the phase locked loop apparatus 50 as a reference frequency to generate the dot clock signal 42.

A timer device 44 is responsive to the HSYNC signal 16 for generating a measured horizontal synchronization frequency (MEAS_HSYNC) signal 45 to facilitate the control of the dot clock signal 42.

The apparatus 10 further includes a control apparatus 30 to enable the user to manually adjust the phase and frequency of the DOT_CLK signal 42 with a single control. In this regard, the control apparatus 30 includes a potentiometer device 38 for generating a clock adjust (CLK_ADJ) signal 39. It will be understood by one skilled in the art that other devices may be used to generate the CLK_ADJ signal 39.

A microprocessor 32 is responsive to the CLK_ADJ signal 39 and to the MEAS_HSYNC signal 45 for generating simultaneously a delay (DELAY_STEPS) signal 34 for controlling the phase of the DOT_CLK signal 42, and a dot clock divisor (N) signal 36 to control the frequency of the DOT_CLK signal 42.

The DELAY_STEPS signal 34 is defined by the following equation:

$$\text{DELAY_STEPS} = \text{DELAY_STEP_SIZE} \cdot \frac{(\text{CLOCK ADJ MOD CLOCK STEPS})}{(\text{MEAS_HSYNC} \cdot \text{N})} \quad (1)$$

where DELAY_STEP_SIZE=the delay time of each DELAY_STEPS interval; N=CLOCK_ADJ/CLOCK_STEPS; and CLOCK_STEPS=the number of synthetic clock adjustments between each new divisor selection.

The N signal 36 is indicative of an integer for use as a divisor by the phase detector 52 to generate the DOT_CLK signal 42. By varying the integer used as the divisor, the microprocessor 32 is able to control the frequency of the DOT_CLK signal 42.

To facilitate the stabilization of the displayed image, the microprocessor 32 controls the phase and frequency of the dot clock signal 42 substantially simultaneously in response to the CLK_ADJ signal 39. As will be described in greater detail hereinafter, the stabilization of the displayed image is performed visually. An unstable image may include one or more vertical noise bars, and may also include other indicators of an unstable image.

Generally, the display of a vertical noise bar is indicative of the DOT_CLK signal 42 being too fast or too slow (i.e., the divisor indicated by the N signal 36 corresponds to a DOT_CLK signal 42 having a frequency that does not properly match the foregoing of the image information signal 12 to produce a stable image). Other noise present in the unstable image may result from the phase of the DOT_CLK signal 42 not being properly synchronized with the phase of the image information signal 12. Thus, it is necessary that both the phase and frequency of the DOT_CLK signal 42 be adjustable.

By adjusting the phase and frequency of the DOT_CLK signal 42 substantially simultaneously in response to the CLK_ADJ signal 39 generated by the potentiometer device 38, the microprocessor 32 facilitates the visual stabilization of the image. Utilizing a single adjustment device, such as the potentiometer device 38, or a slider image (not shown) graphically displayed under software control, a user can vary the phase of the DOT_CLK signal 42 while maintaining the frequency thereof. Continuing to adjust the CLK_ADJ signal 39 will increase or decrease incrementally the frequency of the DOT_CLK signal 42, and the adjustment of the phase is repeated.

In this regard, the microprocessor 32 adjusts the delay signal 34 in a stepwise manner through a predetermined range to vary the phase of the DOT_CLK signal 42 while maintaining the N signal 36 at a constant value. The number of steps in the range is preferably about twelve, however, other amounts of steps are acceptable. The number of steps in the range is stored by the microprocessor 32 for determining the appropriate DELAY_STEPS signal 34.

To facilitate the adjustment of the DOT_CLK signal 42, a user interface system (not shown) responsive to a remote input device (not shown) may be coupled to the microprocessor 32. Entering an adjust command on the remote input device by depressing a single button thereon (not shown) enables the user interface system to cooperate with the microprocessor 32 for generating the DOT_CLK signal 42. By holding the button down, the user is able to continuously adjust the DOT_CLK signal 42 until the phase and frequency thereof are satisfactory to stabilize the displayed image.

An accelerated adjust function is activated when the button is depressed for a predetermined amount of time, wherein the adjustment of the phase and frequency of the DOT_CLK signal 42 is modified to occur at a faster rate. As a result, the user can view the image and notice the corrective action being taken to remote this vertical noise bars. By releasing the button, the accelerated adjust function is terminated, and further adjustments may be made at the regular rate of adjustment to fine tune the image. In this way, the image can be stabilized quickly and easily by the user viewing the displayed image.

After adjusting the delay signal 34 through the predetermined range, the microprocessor 32 adjusts the N signal 36 incrementally to vary the frequency of the DOT_CLK signal 42. The stepwise adjustment of the delay signal 34 can then be repeated for the new frequency. In this way, the microprocessor 32 is responsive to the CLK_ADJ signal 39 to vary the phase and frequency of the DOT_CLK signal 42 substantially simultaneously.

Figure 2:
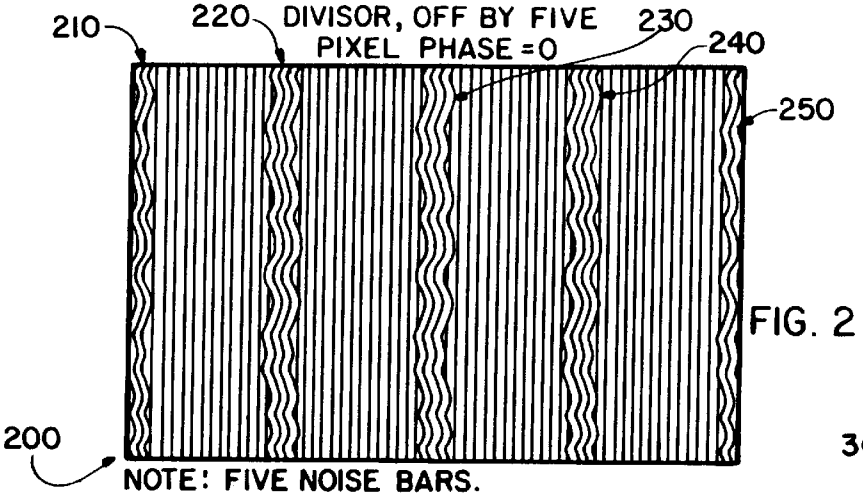
FIGS. 2–17 are images displayed by the image display stabilization apparatus of FIG. 1.

As shown in FIGS. 2–17, the stabilization of an unstable image is visually accomplished by the user viewing the displayed image while controlling the potentiometer device 38. The display of FIG. 2 illustrates an unstable image 200 having vertical noise bars 210, 220, 230, 240 and 250 indicative of an unstable image. The vertical noise bars 210, 220, 230, 240 and 250 are indicative of the N signal being out of adjustment by about five (i.e., the frequency of the DOT_CLK signal 42 does not correspond to the frequency of the image information signal 12).

Figure 3:
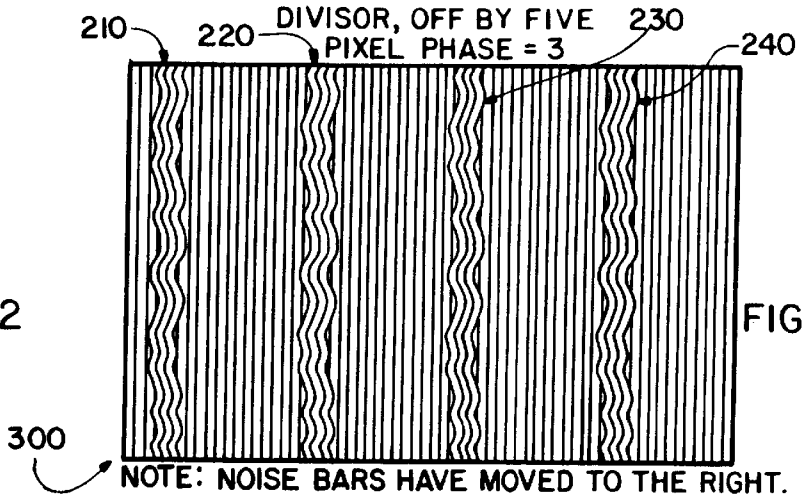
Figure 4:
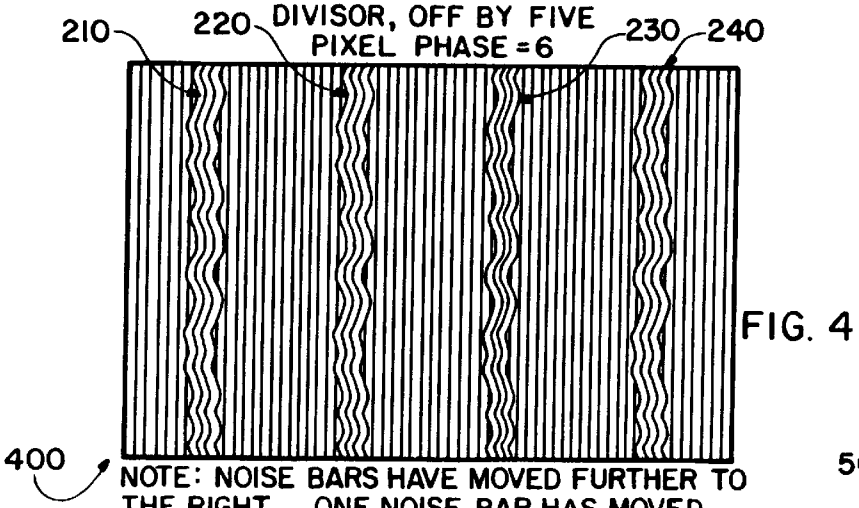
Figure 5:
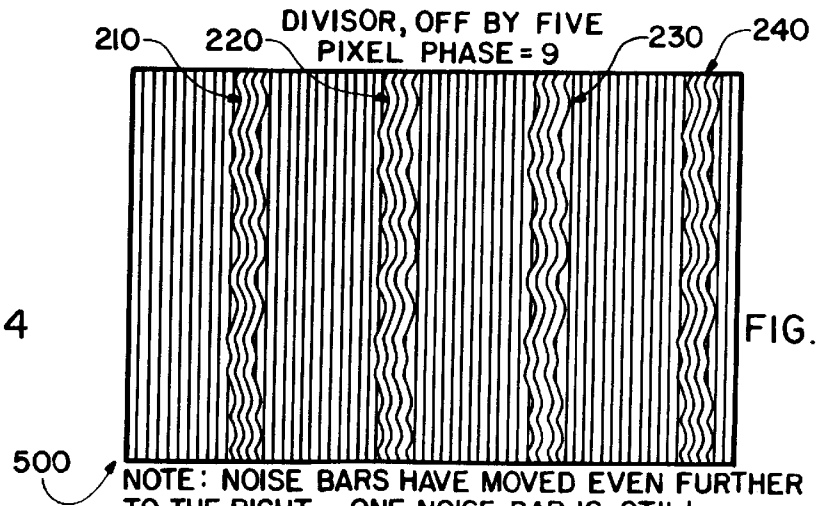
Figure 6:
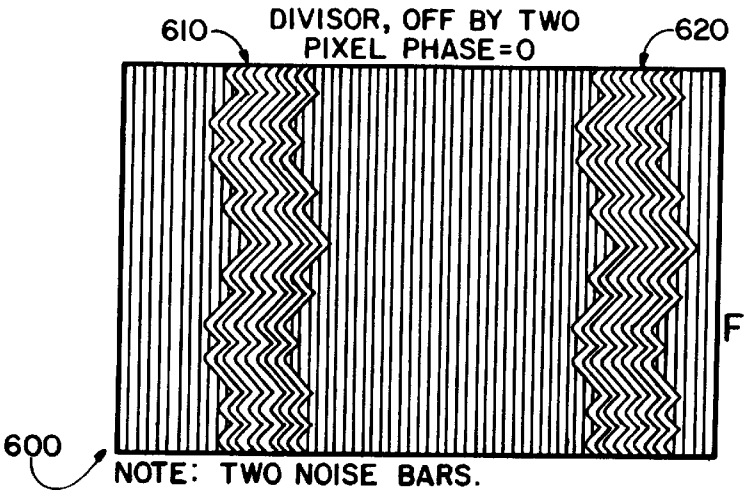
Figure 7:
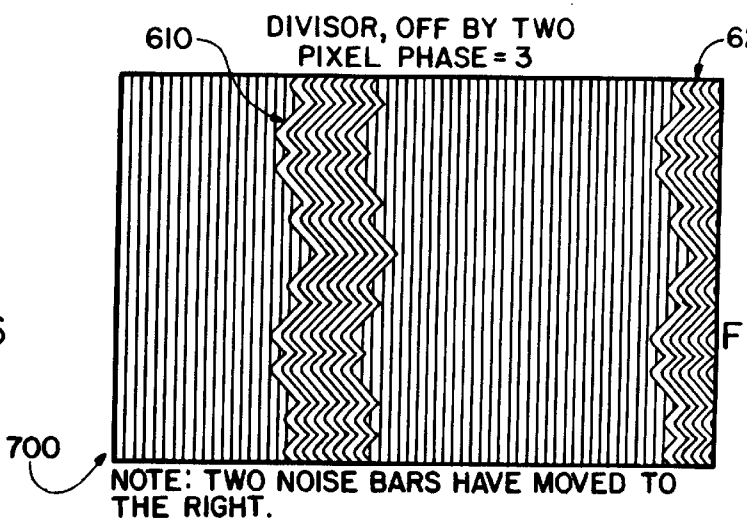
Figure 8:
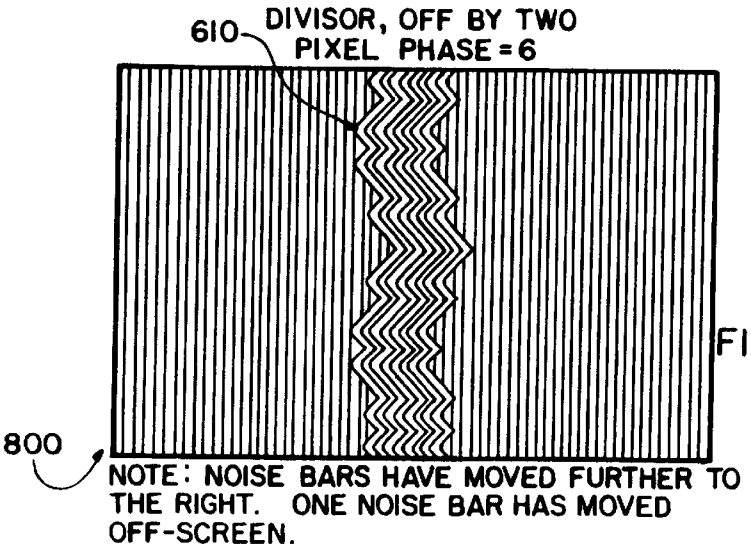
Figure 9:
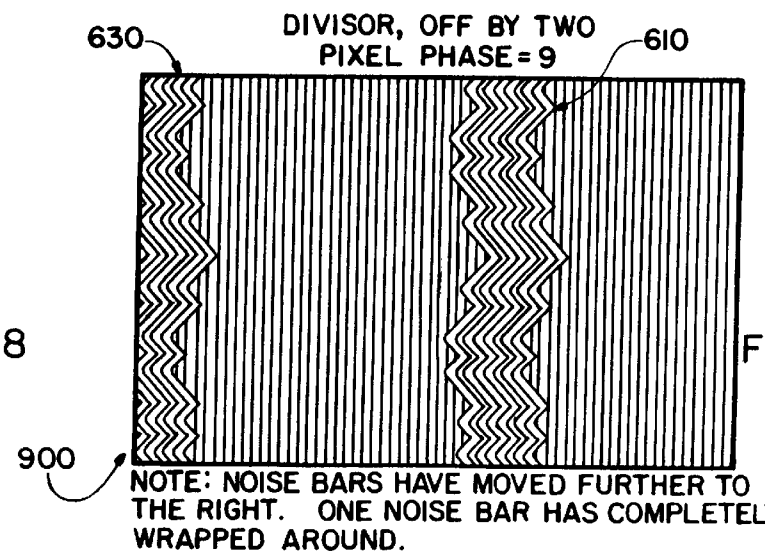

FIG. 3 illustrates a subsequently displayed image 300 wherein the user has adjusted the potentiometer device 38 to vary the CLK_ADJ signal 39. In this regard, the N signal 36 has remained constant. However, the delay signal 34 has been increased, thereby causing the vertical noise bars 210, 220, 230, 240 and 250 to move to the right relative to the displayed image 300 which is indicative of the adjustment of the phase of the DOT_CLK signal 42. The vertical noise bar 250 has moved off of the screen and cannot be viewed.

Continuing to adjust the potentiometer device 38 results in the N signal 36 remaining constant while the delay signal 34 continues to increase. As a result, the noise bars 210, 220, 230, 240 and 250 continue to move to the right. The movement of the noise bars 210, 220, 230, 240 and 250 can be seen in unstable image 400 (FIG. 4) and unstable image 500 (FIG. 5), wherein the vertical noise bar 250 remains off of the display.

Continuing to adjust the CLK_ADJ signal 39 enables the delay signal 34 to go beyond the given range, wherein the delay signal 34 returns to its original starting point. Simultaneously, the N signal is incremented by one.

FIGS. 6–9 illustrate the effect of continuing to increase the delay signal 34 until the N signal 36 is off by only two, resulting in two vertical noise bars 610 and 620.

The unstable images 600, 700, 800 and 900 of FIGS. 6–9, respectively, show the progression of the two vertical noise bars 610 and 620 as they march rightwardly across the image due to increasing delay signal 34 while maintaining the N signal 36 at a constant value. Eventually, the vertical noise bar 620 moves off of the screen (FIGS. 8–9), and wraps around the displayed image to appear on the left most side of the screen as vertical noise bar 630 in FIG. 9.

Figure 13:
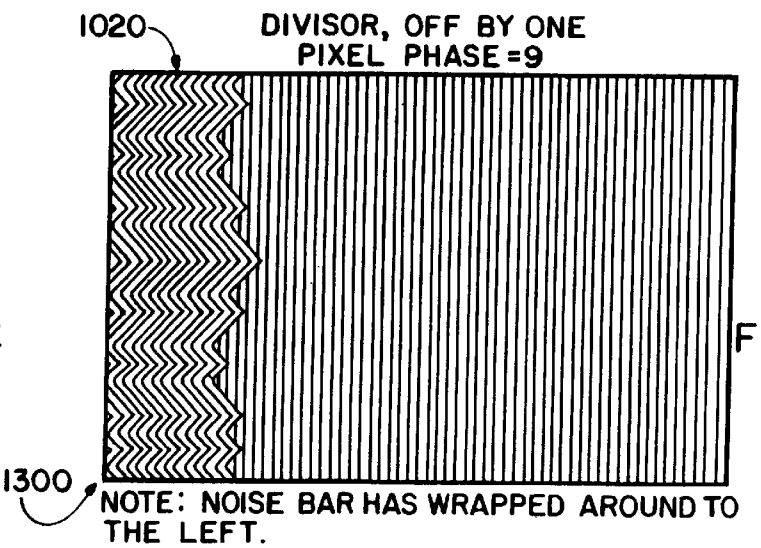
Figure 15:
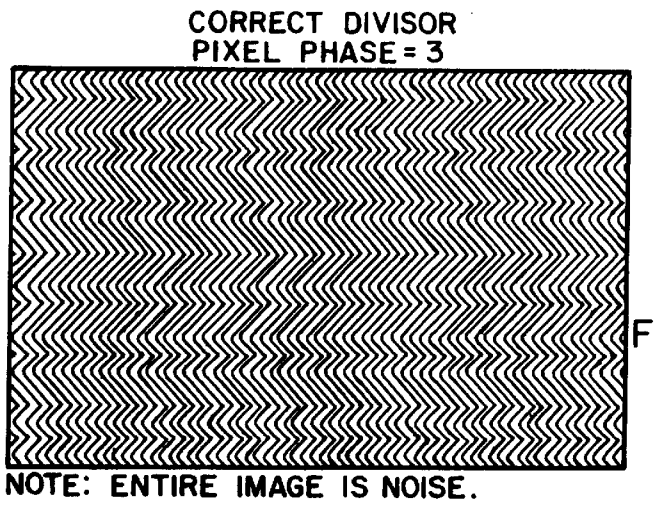

Continuing to adjust the CLK_ADJ signal 39 reduces the number of vertical noise bars to one, wherein the single vertical noise bar indicates that the N signal 36 is off by one. As shown in FIGS. 10–13, a single vertical noise bar 1010 marches across unstable images 1000, 1100, 1200 and 1300 as the delay signal 34 is increased stepwise, while maintaining the value of the N signal 36. As shown in FIG. 13, the vertical noise bar 1010 which marched off of the image 1300 (FIG. 12), reappears as the single vertical noise bar 1020.

The continued adjustment of the CLK_ADJ signal 39 results in the elimination of any visible vertical noise bars from the displayed image, such as the images shown in FIGS. 14–17. The elimination of all vertical noise bars is indicative of the correct N signal 36 being generated by the microprocessor 32 in response to the CLK_ADJ signal 39. However, the synchronization of the phase of the DOT_CLK signal 42 with the phase of the image information signal 12 may still require adjustment.

In this regard, the delay signal 34 is adjusted while maintaining the N signal 36 to display the most stable image. Thus, the image 1400 of FIG. 14 appears to be stable. Continuing to adjust the delay signal 34 results in a noisy image 1500. Further adjustment of the delay signal 34 results in the images 1600 and 1700 (FIGS. 16 and 17) which contain no apparent noise.

As the image 1400, 1600 and 1700 are relatively free of distracting noise, any one of these images would be considered to be a stabilized image.

As described previously, the image is stabilized by adjusting simultaneously the phase and frequency of the DOT_CLK signal 42 with a single potentiometer device 38. Thus, the user is not required to determine what adjustments need to be made. Instead, the user need only control the device 38 until all noise bars are gone and the image is noise free.

Figure 18:
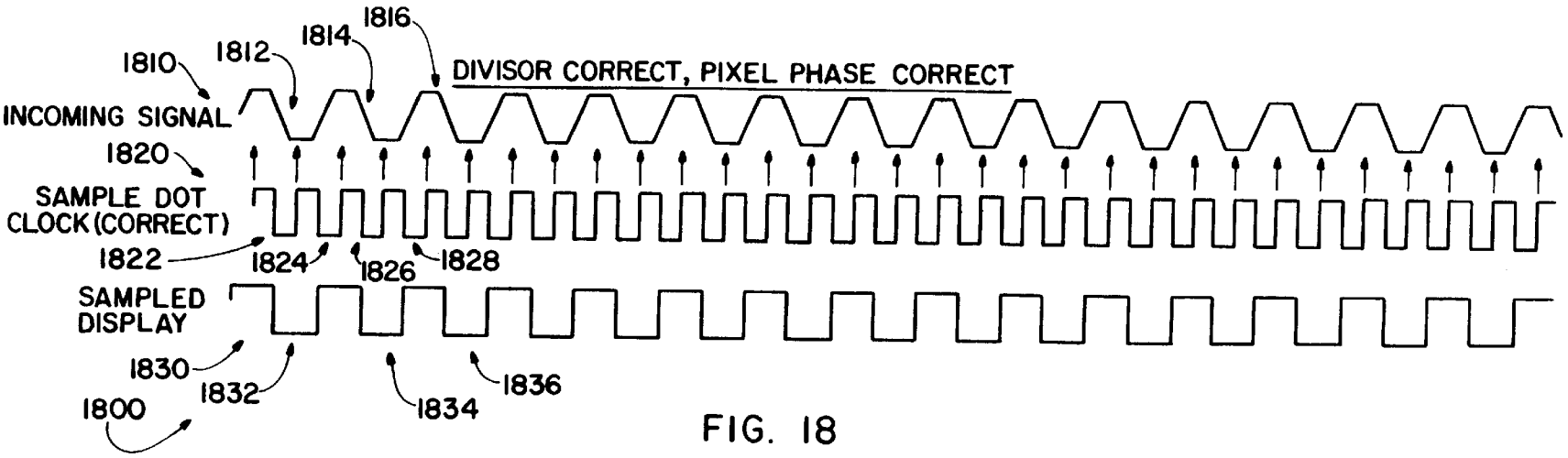
FIG. 18 is a timing diagram for a stabilized image.

The display of a stabilized image is dependent upon the synchronization of the incoming image information signal 12 with the DOT_CLK signal 42, as well as correlating the frequency of the DOT_CLK signal 42 with the frequency of the image information signal 12. The timing diagram 1800 of FIG. 18 illustrates the relationship between an incoming signal 1810 and a dot clock signal 1820 to produce a stable display signal 1830.

The incoming signal 1810 includes a plurality of image pulses, such as pulses 1812, 1814 and 1816. Transitional periods between the pulses 1812, 1814 and 1816 do not provide information for displaying the stabilized image. Therefore, the dot clock signal 1820, which includes a plurality of pulses such as pulses 1822, 1824, 1826 and 1828, must be synchronized to sample the incoming signal 1810 only during specific on and off periods of the pulses 1812, 1814 and 1816. By avoiding the sampling of the signal

1810 during the transitional periods, the display signal 1830, having pulses 1832, 1834 and 1836, is produced, and which is indicative of a stable image.

Figure 19:
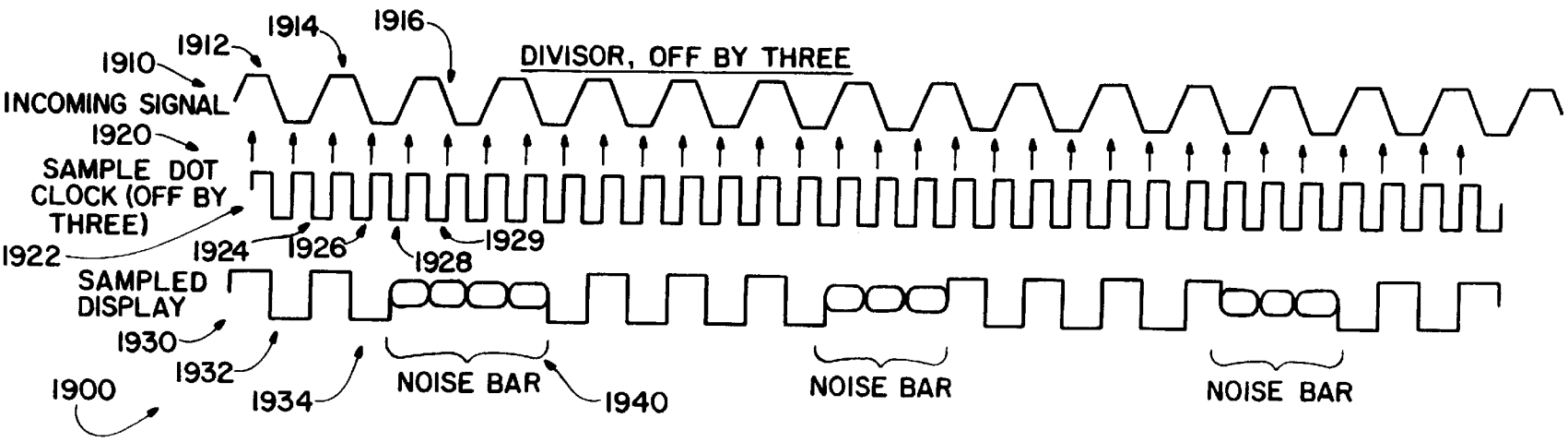
FIG. 19 is a timing diagram for an unstable image.

Simply synchronizing the phase of the incoming signal with the phase of the dot clock signal is not sufficient to produce a stable image, as shown in FIG. 19. In this regard, the timing diagram 1900 of FIG. 19 illustrates an incoming signal 1910, a dot clock signal 1920 and the resulting display signal 1930 indicative of an unstable image. While the dot clock signal 1920 is synchronized with the incoming signal 1910 indicating that the appropriate DELAY_STEPS signal is being generated, the frequency of the signal 1920 is not adjusted to correspond to the frequency of the incoming signal 1910.

The signal 1910, including the pulses 1912, 1914 and 1916, is substantially similar to the incoming signal 1810 of FIG. 18. The dot clock signal 1920, including pulses 1922, 1924, 1926, 1928 and 1929, however, has a different frequency from the dot clock signal 1820. As a result, the dot clock signal 1920 initially corresponds to the on and off portions of the pulses 1912 and 1914 to produce display pulses 1932 and 1934. In this regard, the pulses 1922 and 1926 of the dot clock signal 1920 correspond to the on portion of the pulses 1912 and 1914, while the pulses 1924 and 1928 correspond to the off portions of the pulses 1912 and 1914.

However, the pulse 1929 corresponds to a transitional period between the pulse 1914 and 1916 of the incoming signal 1910. As a result, the sample display signal 1930 is unstable, and a noise bar 1940 results. This pattern is repeated for each occurrence of a dot clock pulse during transitional periods of the incoming signal.

Figure 20:
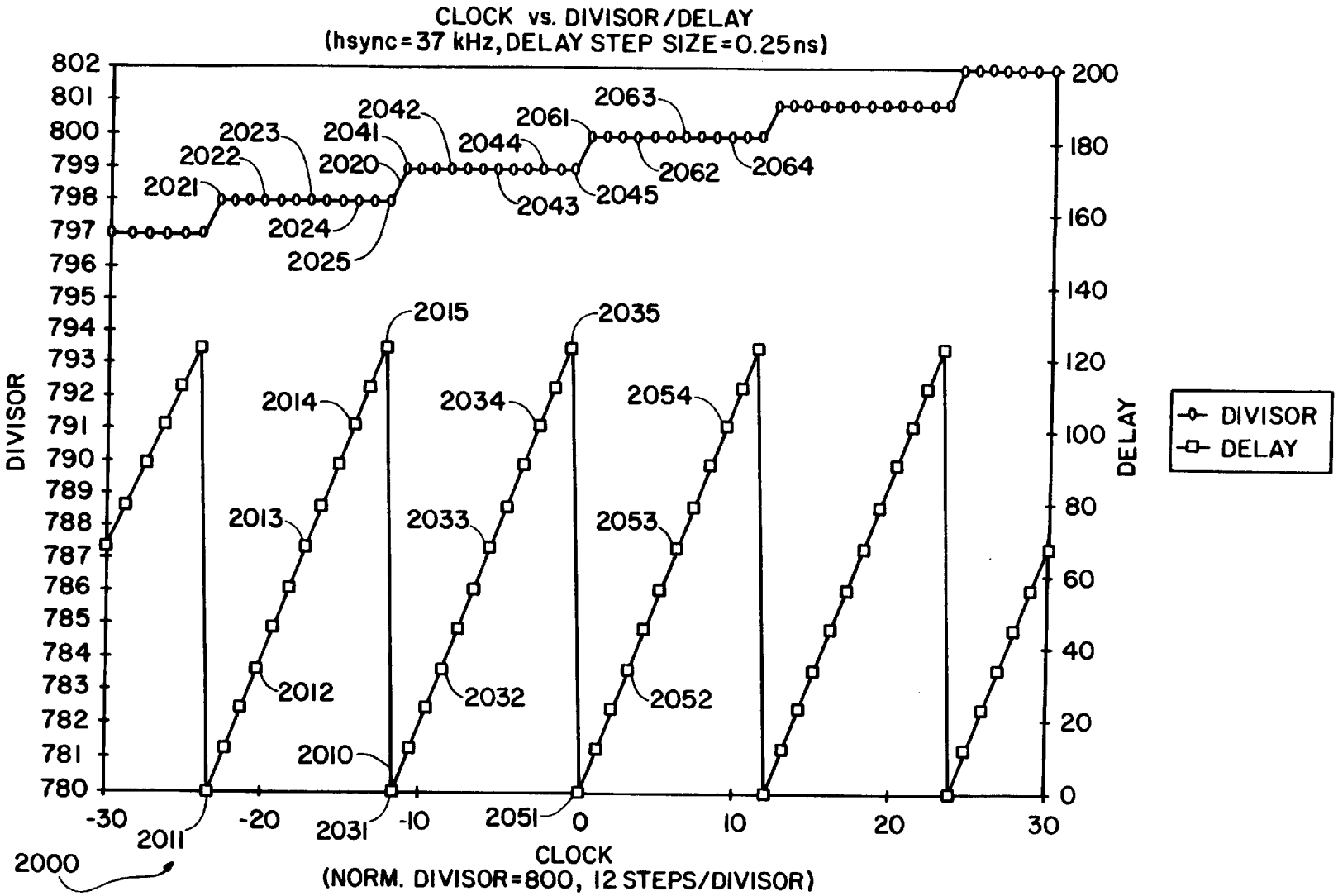
FIG. 20 is a graphical representation of a divisor count and delay period corresponding to a clock adjust signal for the image display stabilization apparatus of FIG. 1.

Considering now the operation of the apparatus 10 with regard to graph 2000 of FIG. 20, the graph 2000 illustrates the relationship of a divisor as determined by the N signal 36 and the delay signal 34 with regard to the CLK_ADJ signal 39. In this regard, the divisor is indicated on the left vertical axis, the delay signal 34 (Delay) is indicated on the right vertical axis, and the CLK_ADJ signal (Clock) is indicated along the lower horizontal axis. It should be noted that the divisor is indicative of the frequency of the DOT_CLK signal 42 while the delay is indicative of the phase of the DOT_CLK signal 42.

The line 2010 indicates the changes in the delay signal 34 as the CLK_ADJ signal is varied. The line 2020 indicates the value of the divisor corresponding to the CLK_ADJ signal. As shown in the graph 2000, the line 2010 varies in a stepwise manner through a given range in twelve increments, while maintaining the divisor at a given value. In this regard, the delay signal increases through a range of twelve increments while the divisor remains constant. The adjustment of the delay signal 34 is repeated in the stepwise manner for each value of the divisor.

During the adjustment of the delay signal 34, the N signal remains constant. Increasing, or decreasing, the CLK_ADJ signal 39 beyond the given range causes the N signal 36 to incrementally increase, or decrease, accordingly, wherein the delay signal 34 repeats the stepwise adjustment through the same given range. The process is repeated until the correct N signal 36 and delay signal 34 are obtained.

As shown in FIG. 20 for an HSYNC signal of 37 KHz and a delay step signal of 0.25 ns, a nominal CLOCK position is shown on the horizontal axis of graph 2000 as position 0. A nominal DIVISOR value of 800 and DELAY value of 0 are associated with the nominal CLOCK position. It will be understood by one skilled in the art that the selection of the nominal values for the CLOCK and the DIVISOR is arbitrary.

Increasing the CLK_ADJ signal from its value at the nominal CLOCK position is indicative of moving rightwardly along the horizontal axis from the 0 position. As the CLOCK position is adjusted rightwardly, indicating that the CLK_ADJ signal is being increased, the delay signal is increased stepwise through twelve increments (from a minimum value to a maximum value) as indicated by the DELAY vertical axis.

As the CLOCK position and the DELAY value are increased, the DIVISOR value remains constant.

Continuing to increase the CLOCK position after the twelfth increment of the DELAY value simultaneously causes the DELAY value to return to 0 and the DIVISOR value to increase by one to 801. Further increases in the CLOCK position (increasing the CLK_ADJ signal) cause the DELAY value to be increased incrementally through the same range of twelve increments.

Similarly, decreasing the CLOCK position from the nominal CLOCK position causes the DELAY value to be adjusted incrementally, although in a descending stepwise manner. In this regard, decreasing the CLK_ADJ signal (moving the CLOCK position leftwardly along the horizontal axis) simultaneously increases the DELAY value to the incremental value indicative of the maximum delay signal, and decreases the DIVISOR value (the N signal) by one. The DELAY value is then decremented in a stepwise manner through the remaining steps of the range until the DELAY value is decreased to 0 again, wherein the cycle may be repeated again.

From the foregoing, it is apparent that the adjustment of the CLOCK position (increasing or decreasing the CLK_ADJ signal) facilitates the adjustment of both the DELAY value and the DIVISOR value. It will be understood by one skilled in the art the graph 2000 represents only a portion of the possible values for CLOCK, DELAY and DIVISOR, and that the cycle of twelve stepwise increments of the delay signal for each N signal incremental value may be repeated from other positions not shown.

For example, assuming a divisor of 800 is required to properly adjust the frequency of the DOT_CLK signal 42 as illustrated in FIGS. 6–17, the image 600 (FIG. 6) corresponds to delay position 2011 of line 2010 and divisor position 2021 of line 2020. Adjusting the CLK_ADJ signal 39 results in image 700 (FIG. 7), corresponding to delay position 2012 of line 2010 and divisor position 2022 of line 202. Continuing to adjust the CLK_ADJ signal 39 produces the images 800 (delay position 2013, divisor position 2023) and 900 (delay position 2014, divisor position 2024).

Figure 10:
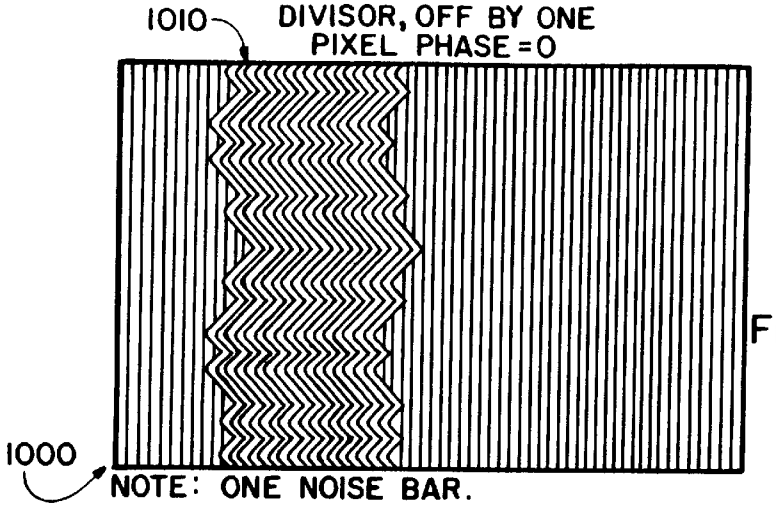
Figure 11:
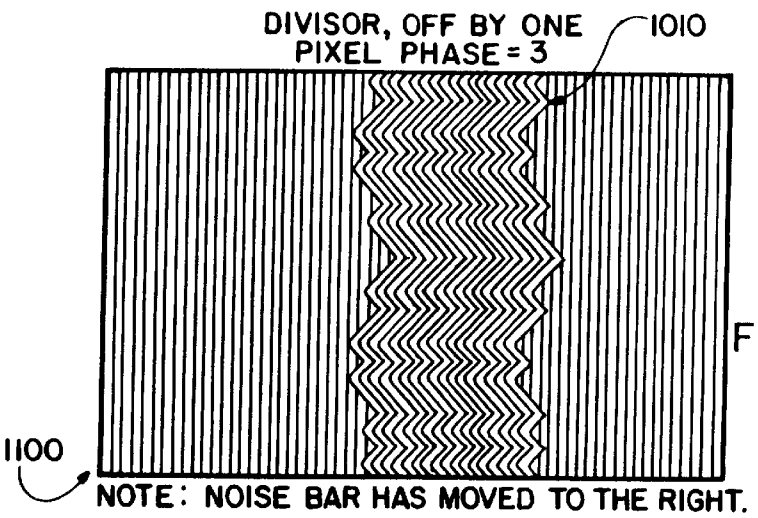
Figure 12:
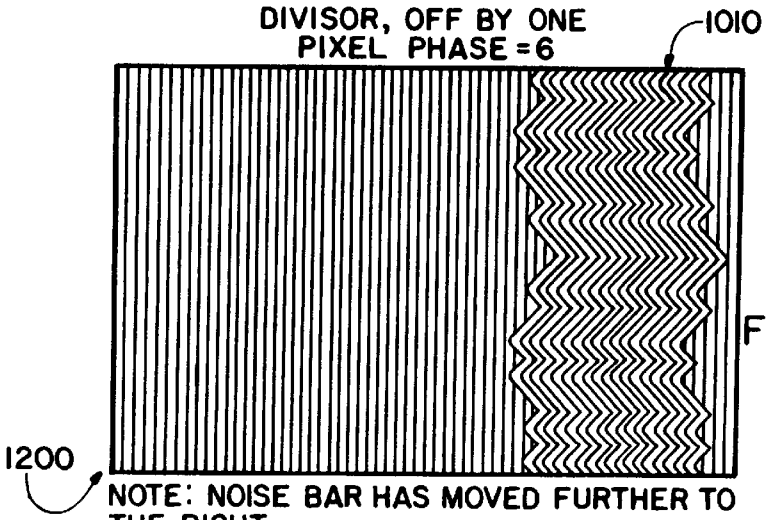

Delay position 2015 and divisor position 2025 represent the end of an adjustment cycle. Continuing to adjust the CLK_ADJ signal 39 causes a new cycle to begin, wherein the delay is returned to zero at delay position 2031 and the divisor is incremented by one to divisor position 2041. The resulting image at delay position 2031 and divisor position 2041 is shown as image 1000 (FIG. 10). As the divisor value is off by one, a single vertical noise bar is displayed.

Figure 14:
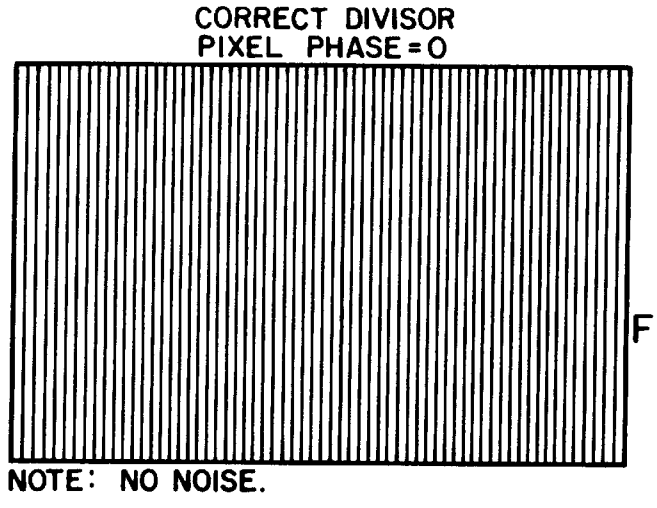
Figure 17:
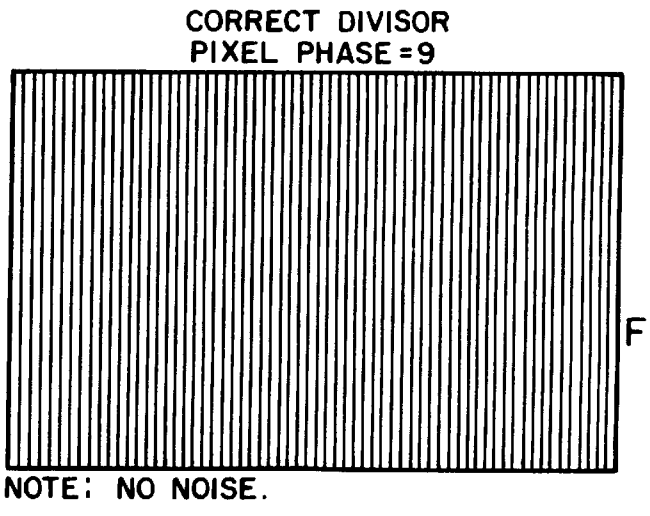
Figure 16:
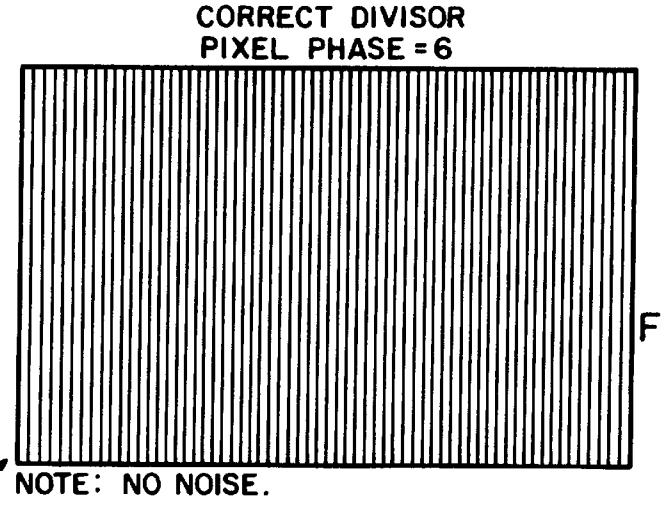

Continuing to adjust the CLK_ADJ signal 39 results in the delay and divisor positions being adjusted through delay position 2032 and divisor position 2042 (FIG. 11), delay position 2033 and divisor position 2043 (FIG. 12), and delay position 2034 and divisor position 2044 (FIG. 13). After passing through delay position 2035 and divisor position 2045, a new cycle is started at divisor position 2051 and delay position 2061 (FIG. 14).

Image 1400 (FIG. 14) is indicative of the divisor being correct (i.e., the frequencies of the DOT_CLK signal 42 and the image information signal 12 correspond and the display of the vertical noise bars is terminated). In addition, the phases of the signals 42 and 12 also appear to be synchronized. Further adjustment of the CLK_ADJ signal 39 results in the noisy image 1500 (FIG. 15) at delay position 2052 and divisor position 2062. Continuing to adjust the CLK_ADJ signal 39 results in the display of images 1600 (FIG. 16) and 1700 (FIG. 17) at delay position 2053 and divisor position 2063, and delay position 2054 and divisor position 2064, respectively.

Figure 21:
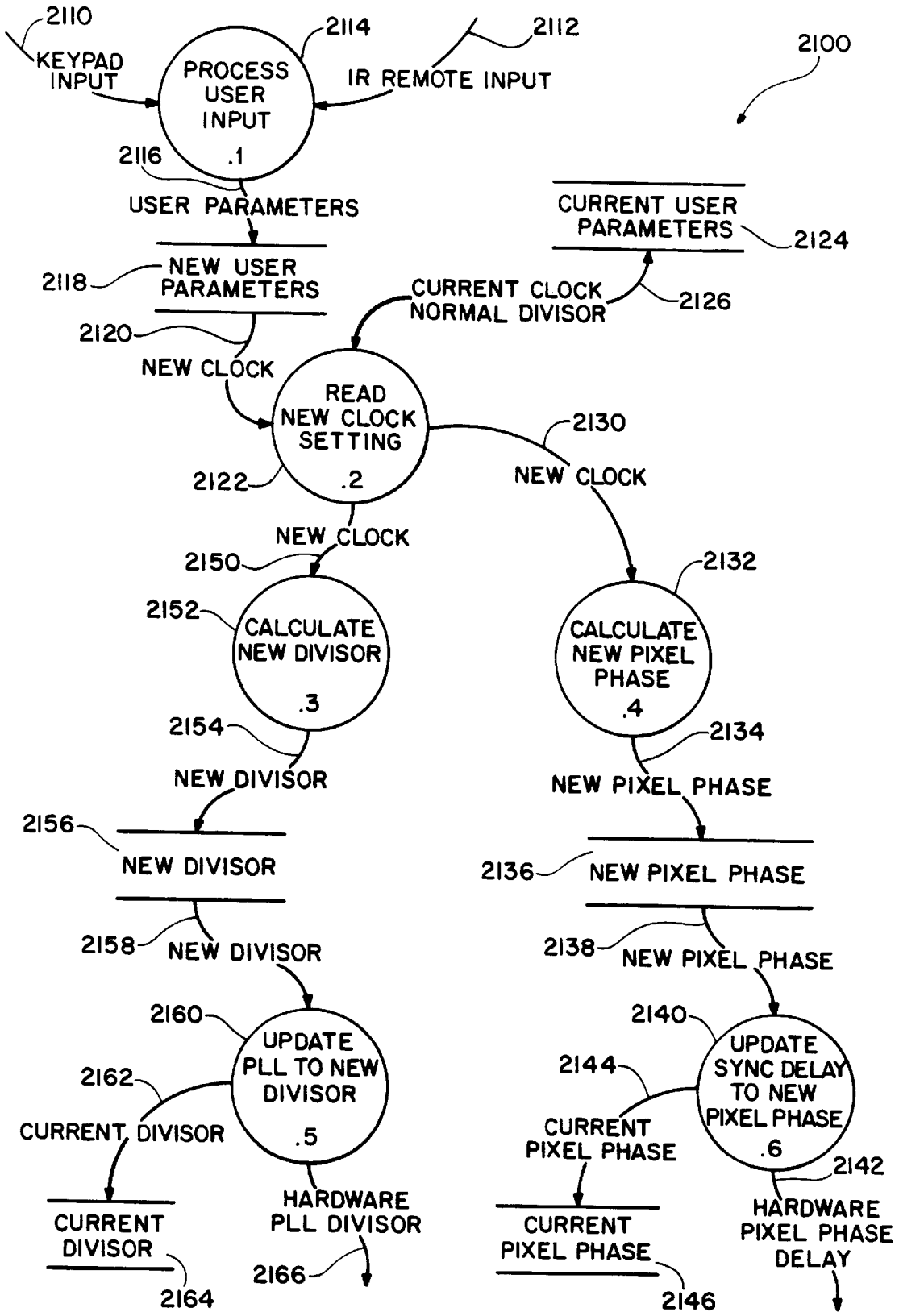
FIG. 21 is a flow diagram for controlling the image stabilization apparatus of the present invention.

Considering now the flow diagram of FIG. 21 in greater detail, the microprocessor 32 is controlled according to the diagram 2100. The microprocessor 32 receives keypad input 2110 or IR remote input 2112. The input 2110 or 2112 is processed and converted into new user parameters 2116 at 2114. The new user parameters 2116, including a clock setting, are stored at 2118. A new clock setting 2120 is determined from the new user parameters 2118, and the new clock setting is read at 2122.

Current user parameters, including current user settings processed by the system to date, are stored at 2124. Current clock and nominal divisor information 2126 is derived from the current user parameters for use in determining an appropriate clock setting at 2122. The nominal divisor is indicative of the divisor value associated with a clock zero position for the CLK_ADJ signal 39.

The current clock setting is compared with the new clock setting at 2122. If the clock settings are different, the new clock setting is saved as the current clock setting. Once the new clock setting is determined, a new pixel phase and new divisor are calculated substantially simultaneously at 2132 and 2152, respectively.

The new clock setting 2130 determined from 2122 is used to calculate a new pixel phase at 2132. The newly calculated pixel phase 2134 is stored at 2136 and is supplied at 2138 to update the synchronization delay signal at 2140 corresponding to the new pixel phase 2138. In this regard, the current phase delay is compared to the new phase delay at 2140. IF the delays are different, the new phase delay is stored and the hardware is updated with the new phase delay at 2142. The current pixel phase that the hardware is set to is stored at 2146 and is supplied to 2140 at 2144.

Similarly, the new clock signal 2150 determined at 2122 is used to calculate a new divisor 2154 at 2152. The new divisor 2154 is calculated from the new clock setting and stored at 2156. Subsequently, the new divisor is supplied at 2158 to update the phase locked loop to a new divisor at 2160. In this regard, the current divisor is compared with the new divisor. Any change results in the new divisor being saved, and the hardware being updated with the new divisor at 2166.

The current divisor is supplied from 2160 and stored as the current divisor 2164.

While particular embodiments of the present invention have been disclosed, it is to be understood that various different modifications are possible and are contemplated within the true spirit and scope of the appended claims. There is no intention, therefore, of limitations to the exact abstract or disclosure herein presented.

What is claimed is:

1. A method for stabilizing a display panel image corresponding to an image information signal having an associated phase and frequency, comprising:

generating a dot clock signal having an associated phase and frequency to facilitate the display of the image information signal as the image;

displaying a vertical noise bar indicative of the dot clock signal frequency not corresponding to the image information signal frequency;

adjusting manually a single control device to generate a clock adjust signal;

controlling said dot clock signal phase and said dot clock signal frequency simultaneously in response to said clock adjust signal to help synchronize said dot clock signal phase with the image information signal phase while adjusting said dot clock signal frequency to correspond to the image information signal frequency;

said controlling including adjusting incrementally said dot clock signal frequency in response to said clock adjust signal until the display of said vertical noise bar is terminated; and said controlling further including maintaining said dot clock signal frequency substantially constant while adjusting said dot clock signal phase in a stepwise manner through a given range in response to said clock adjust signal.

2. A method according to claim 1, further including initially setting said clock adjust signal to correspond to a nominal dot clock signal frequency.

3. A method according to claim 2, wherein said adjusting said dot clock signal includes varying said dot clock signal incrementally in a given number of steps through said given range.

4. A method according to claim 3, wherein said given number of steps is about twelve.

5. A method according to claim 3, wherein said varying of said dot clock signal phase incrementally through said given range is repeated in one direction each time said dot clock signal frequency is increased incrementally.

6. A method according to claim 5, wherein a transition between repeated ranges of dot clock signal phase variations corresponds to transition between the dot clock signal frequency and an incrementally increased dot clock signal frequency.

7. A method according to claim 3, wherein said varying of said dot clock signal incrementally through said given range is repeated in another direction each time said dot clock signal frequency is decreased incrementally.

8. A method according to claim 7, wherein a transition between repeated ranges of dot clock signal phase variations corresponds to transition between the dot clock signal frequency and an incrementally decreased dot clock signal frequency.

9. A display panel image stabilization apparatus, said image corresponding to an image information signal having an associated phase and frequency, comprising:

means for generating a dot clock signal having an associated phase and frequency to facilitate the display of the image information signal as the image;

means for displaying a vertical noise bar indicative of the dot clock signal frequency not corresponding to the image information signal frequency;

a single control device for generating a clock adjust signal;

means for controlling said dot clock signal phase and said dot clock signal frequency simultaneously in response to said clock adjust signal to help synchronize said dot clock signal phase with the image information signal phase while adjusting said dot clock signal frequency to correspond to the image information signal frequency;

said means for controlling including means for adjusting incrementally said dot clock signal frequency in response to said clock adjust signal until the display of said vertical noise bar is terminated; and said means for controlling further including means maintaining said dot clock signal frequency substantially constant while adjusting said dot clock signal phase in a stepwise manner through a given range in response to said clock adjust signal.

10. An apparatus according to claim 9, wherein said means for controlling enables said clock adjust signal to be initially set to correspond to a nominal dot clock signal frequency.

11. An apparatus according to claim 10, wherein said means for controlling varies said dot clock signal incrementally in a given number of steps through said given range.

12. An apparatus according to claim 11, wherein said given number of steps is about twelve.

13. An apparatus according to claim 11, wherein said means for controlling repeats the variation of said dot clock signal phase incrementally through said given range in one direction each time said dot clock signal frequency is increased incrementally.

14. An apparatus according to claim 13, wherein a transition between repeated ranges of dot clock signal phase variations corresponds to transition between the dot clock signal frequency and an incrementally increased dot clock signal frequency.

15. An apparatus according to claim 11, wherein said means for controlling repeats the variation of said dot clock signal incrementally through said given range in another direction each time said dot clock signal frequency is decreased incrementally.

16. An apparatus according to claim 15, wherein a transition between repeated ranges of dot clock signal phase variations corresponds to transition between the dot clock signal frequency and an incrementally decreased dot clock signal frequency.

* * * * *